US005839820A

United States Patent [19]

Huang

[11] Patent Number: 5,839,820

[45] Date of Patent: Nov. 24, 1998

[54] CHRISTMAS LAMP

[76] Inventor: Shun-Feng Huang, No. 13, Lane 84, Nei Hu Road, Hsin-Chu City, Taiwan

[21] Appl. No.: 958,136

[22] Filed: Oct. 28, 1997

[51] Int. Cl.[6] ..... F21P 1/00

[52] U.S. Cl. ..... 362/252; 362/250; 362/391; 362/806

[58] Field of Search ..... 362/249, 250, 362/252, 391, 806

[56] References Cited

U.S. PATENT DOCUMENTS 5,584,567 12/1996 Rumpel ..... 362/249

5,697,698 12/1997 Huang ..... 362/391 X

*Primary Examiner*—Stephen Husar

*Attorney, Agent, or Firm*—Rosenberg, Klein & Bilker

[57] ABSTRACT

A Christmas lamp includes two sockets formed integrally connected with each other with a bridge formed between them for receiving respectively a lamp. A C-shaped wire clamp is formed at an outer side of each socket for clamping a lead wire connecting the two sockets in series. The two lamps fitted in the two sockets are not necessarily of the same standard, forming a double Christmas lamp.

1 Claim, 2 Drawing Sheets

CHRISTMAS LAMP

BACKGROUND OF THE INVENTION

This invention relates to a Christmas lamp, particularly to one having two sockets formed integrally connected with each other, with two lamps of the same standard or different standard variously used to display variations after they are combined into a net of Christmas lamps.

Most conventional Christmas lamps are made as a single socket with a single lamp, and a number of them are connected with one another, formed into a net for deorating Christmas trees, etc. However, they cannot display enough brightness or variations owing to the same color, brightness or size.

SUMMARY OF THE INVENTION

The purpose of the invention is to offer a Christmas lamp having two sockets formed integrally connected with each other for disposing two lamps of the same or different standard.

A feature of the invention is each of two sockets provided with a center cavity for inserting a lamp and a C-shaped wire clamp formed at an upper end of each socket for clamping therein a lead wire.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
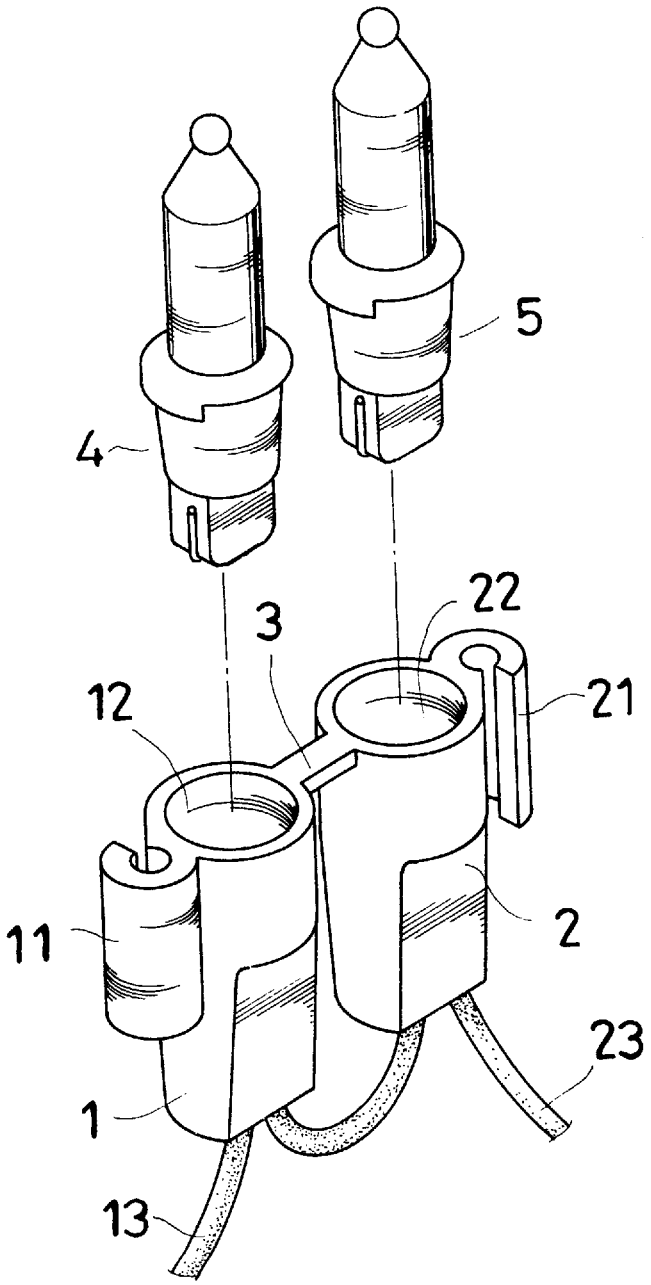
FIG. 1 is an exploded perspective view of a Christmas lamp in the present invention.

A preferred embodiment of a Christmas lamp in the present invention, as shown in FIG. 1, includes two lamp bases 1, 2 formed integrally connected with each other, and a C-shaped wire clamp 11, 21 respectively formed at an outer side of each lamp base 1, 2, and a bridge 3 formed between upper ends of the two lamp bases 1, 2 for connecting the two lamp bases in series together.

Figure 2:
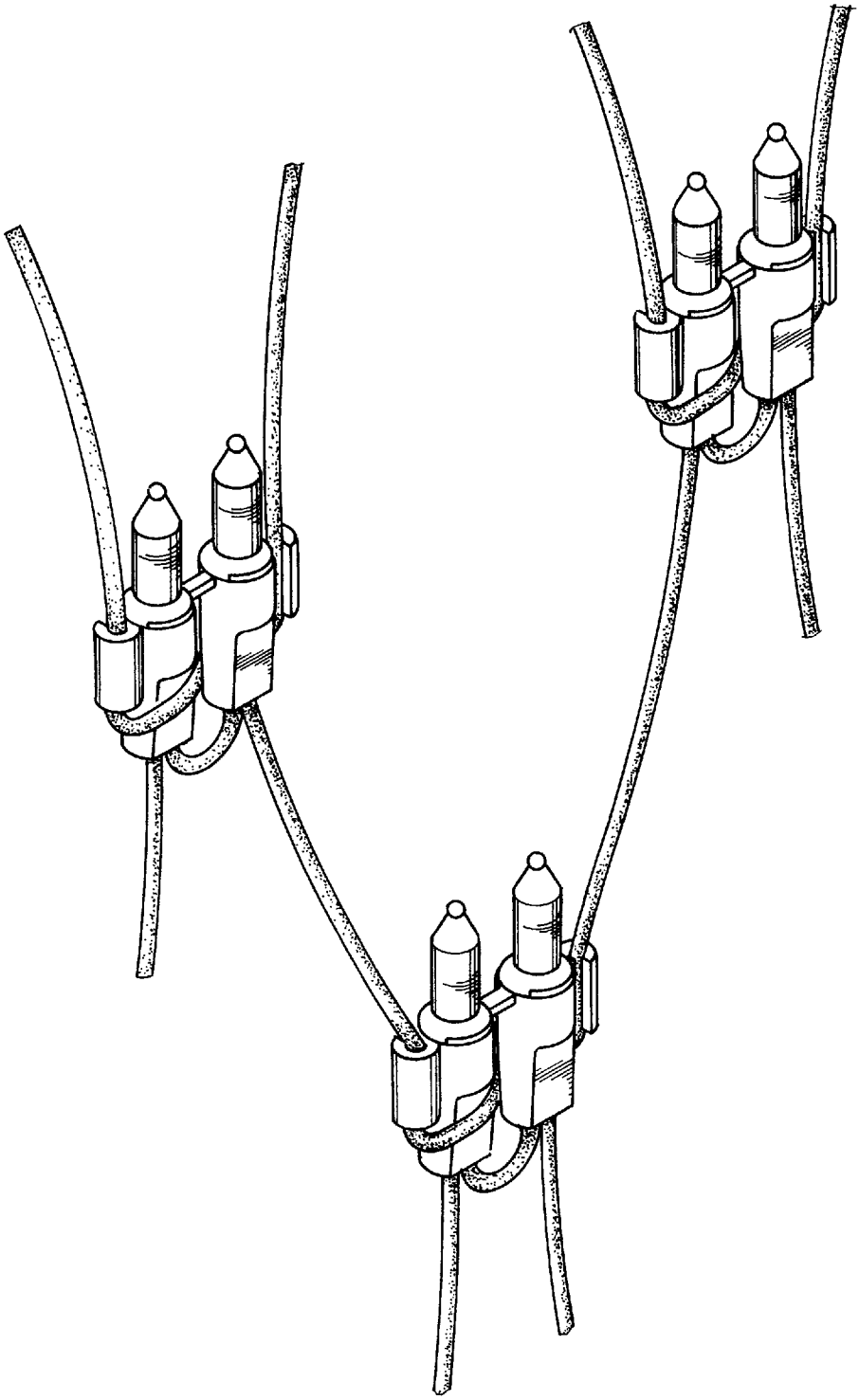
FIG. 2 is a perspective view of the Christmas lamps in the present invention, connected with one another like a network.

Each lamp base 1, 2 has a center cavity 12, 22 for receiving a lamp 4, 5 therein, but the two lamps are not necessarily the same standard, i.e. shape, size, color or blinking frequency, so the Christmas lamp in the present invention may have two different lamps, depending on necessity. Then a number of these Christmas lamps can be connected with one another with lead wires 13, 23, forming a net of Christmas lamps as shown in FIG. 2.

In forming a net of Christmas lamps according to the invention, there can be many variations, such as lamps 4, 5 of different colors, different blinkng frequencies, and alternately lit up, making up a combination of several different designs. And if all the lamps are of the same color, blinking frequency and lit on and off at the same time, the brightness of the whole net is largely augmented.

While the preferred embodiment of the invention has been described above, it will be recognized and understood that various modifications may be made therein and the appended claims are intended to cover all such modifications which may fall within the spirit and scope of the invention.

What is claimed is:

1. A Christmas lamp comprising two lamp sockets, formed integrally connected with each other and a lamp respectively inserted in each said lamp socket, each said lamp socket having a C-shaped wire clamp formed at an outer side of each said lamp socket, and a bridge formed between upper ends of said two lamp sockets, for connecting said two lamp sockets with each other, lead wires of said two lamp sockets connected in series, said two lamps being not necessarily of the same standard so that one Christmas lamp may have two sockets with two lamps.

* * * * *